US005148931A

United States Patent [19]

Minh

[11] Patent Number: 5,148,931

[45] Date of Patent: Sep. 22, 1992

[54] SAFETY CLOSURES FOR THREADED CONTAINERS

[76] Inventor: Do Le Minh, 17231 Regulus Dr., Yorba Linda, Calif. 92686

[21] Appl. No.: 616,661

[22] Filed: Nov. 21, 1990

[51] Int. Cl.[5] ..... B65D 55/02

[52] U.S. Cl. ..... 215/220; 215/230; 215/250

[58] Field of Search ..... 215/201, 206, 219, 220, 215/223, 250, 230, 253

[56] References Cited

U.S. PATENT DOCUMENTS

| | | | |
|---|---|---|---|
| 2,597,307 | 5/1950 | Elkind . | |
| 3,627,160 | 12/1971 | Horvath . | |
| 3,669,294 | 6/1972 | Petronelli et al. | 215/220 |
| 3,795,338 | 3/1974 | Swartzbaugh et al. | 215/220 |
| 3,797,688 | 3/1974 | Porcelli et al. | 215/220 |
| 3,820,676 | 6/1974 | Mucsi | 215/220 |
| 3,830,390 | 8/1974 | Gach | 215/220 |
| 3,857,505 | 12/1974 | Mumford et al. . | |
| 3,926,328 | 12/1975 | Cistone | 215/220 |
| 3,968,894 | 7/1976 | Herrmann | 215/220 |
| 4,353,474 | 10/1982 | Luker | 215/220 |
| 4,523,688 | 6/1985 | Puresevic et al. | 215/220 |
| 4,527,701 | 7/1985 | Schaubeck | 215/220 |
| 4,632,264 | 12/1986 | Evans | 215/220 |
| 4,984,700 | 1/1991 | Knickerbocker | 215/251 |

FOREIGN PATENT DOCUMENTS

| | | | |
|---|---|---|---|
| 0026284 | 4/1981 | European Pat. Off. | 215/220 |
| 2137601 | 10/1984 | United Kingdom | 215/219 |

*Primary Examiner*—Stephen Marcus
*Assistant Examiner*—Stephen Cronin

[57] ABSTRACT

This invention provides a new and simple tamper-resistant, safety closure for a container having threaded neck. It requires the user to align the two arrows, then give it an upward lift while turning in the counter-clockwise direction to unscrew it from the container.

Features of the invention useful in accomplishing the above objects include an outer cap and an inner cap. The interior surface of the outer cap has a plurality of identical protrusions, called the type A protrusions, and one type B protrusion. The exterior surface of the inner cap has a plurality of identical grooves, called the type A grooves, and one type B groove. If the type B protrusion is lifted into the type B groove, then the two caps inter-lock and turning the outer cap in the counter-clockwise direction would also turn the inner cap in the same direction, resulting in the unscrewing of the closure from the container. On the other hand, if the type B protrusion is lifted into one of the type A grooves, then the outer cap will rotate without unscrewing the inner cap from the container.

10 Claims, 8 Drawing Sheets

SAFETY CLOSURES FOR THREADED CONTAINERS

FIELD OF THE INVENTION

The present invention relates to a safety closure for a threaded container, which is made up of a threaded inner cap and an outer cap covering the inner cap.

SUMMARY OF THE INVENTION

It is well recognized that there is a potential hazard resulting from the use of containers containing toxic materials, medicines, corrosive substances and the like. It is therefore highly desirable that certain persons—notably small children and mentally disturbed persons—be hindered in their ability to open these containers. In fact, it is required by law that those containers have safety closures to discourage small children in their idle attempts to open them.

Prior art safety closures to be used with threaded containers have not been performing satisfactorily. Most commercially available closures require the user to exert a downward pressure on them while simultaneously rotating them in the counter-clockwise direction to unscrew them from the container. Typical of this push-down-and-turn type is taught by Mumford et. al., U.S. Pat. No. 3,857,505. Since the downward pressure creates a friction between the threads, it requires a stronger torque to unscrew the closure from the container than that required to unscrew an equivalent non-safety one. Typical of another type of closure is that taught by Cistone, U.S. Pat. No. 3,926,328, which requires the wall of the closure to be deformed while it is simultaneously rotated in the counter-clockwise direction to unscrew it from the container. These types of closures have caused hardship and inconvenience for the elderly and those who are afflicted with arthritis, etc. . . . There is in fact a growing consumer resistance to purchase pharmaceutical products having closures like these, which are inherently difficult to operate.

On the other hand, typical of prior art safety closures to be used with containers which do not have threaded necks is that taught by Horvath, U.S. Pat. No. 3,627,160. It requires the user to rotate the closure first to a certain position relative to the container, then snap it out of the container. This relative position can be recognized by the alignment of two arrows, one in the closure and one in the container. Evidently, closures of this type satisfy the legal safety requirements.

The principle here is to try to prevent those who do not know how to remove the closures from the containers from doing so, rather than to require the users to exert a stronger force than that required to remove an equivalent non-safety closure.

A principal object of this invention is to provide a new and improved safety closure for containers having threaded necks, which can be unscrewed only by persons having given instruction and skill. Once a person follows the prescribed steps, to unscrew the closure from the container, he or she does not need to exert any force stronger than that which would be required to unscrew an equivalent non-safety closure.

Another object of this invention is to provide a new and improved safety closure which is not too complicated to be unscrewed from a container having threaded neck, yet sufficiently complicated to prevent a child from doing so. It requires the user to align two arrows, then give the closure an upward lift while turning it in the counter-clockwise direction.

Another object of this invention is to provide a new and improved safety closure which is tamper-resistant; i.e., it provides a means of determining whether anyone has attempted to unscrew the closure from the container.

Another object of this invention is to provide a new and improved safety closure which can be converted into a non-safety closure.

Another object of this invention is to provide a new and improved safety closure which is not too complicated for design and manufacture, at least not more complicated than any existing closure having an inner cap and an outer cap.

Features of the invention useful in accomplishing the above objects include an outer cap and an inner cap. The interior surface of the outer cap has a plurality of identical protrusions, called the type A protrusions, and one type B protrusion. The exterior surface of the inner cap has a plurality of identical grooves, called the type A grooves, and one type B groove. If the type B protrusion is lifted into the type B groove, then the two caps inter-lock and turning the outer cap in the counter-clockwise direction would also turn the inner cap in the same direction, resulting in the unscrewing of the closure from the container. On the other hand, if the type B protrusion is lifted into one of the type A grooves, then the outer cap will rotate without unscrewing the inner cap from the container.

The foregoing and other objects of the present invention, as well as the present invention itself and its embodiments, may be more fully understood from the following description, when read in conjunction with the accompanying drawings.

DETAIL DESCRIPTION OF THE INVENTION

Figure 1:
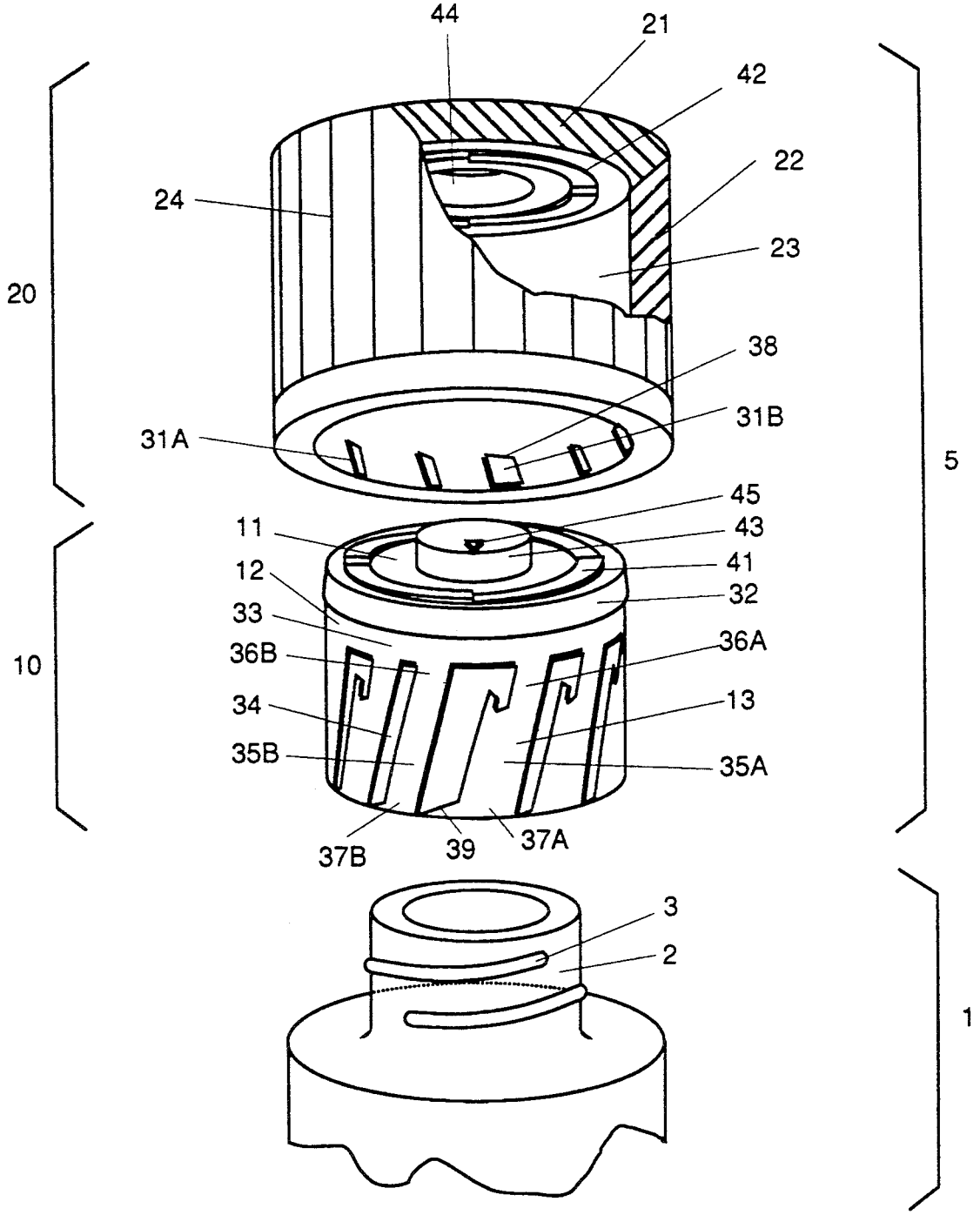
FIG. 1 represents a perspective view of the container, the outer cap and the inner cap.

Referring to FIG. 1, there is shown a container 1, having a cylindrical neck 2, and a thread 3 molded about the exterior of neck 2. It is convenient to position container 1 so that its axial direction is vertical and neck 2 is above container 1.

The safety closure 5, designed to be used with container 1, has two parts: the inner cap 10 and the outer cap 20.

Inner cap 10 has a circular top panel 11 and a cylindrical side wall 12, integrally formed therewith and depending from the periphery thereof. Side wall 12 has an interior surface and an exterior surface 13. The interior surface has an internal thread for engagement with thread 3, to secure inner cap 10 onto container 1.

Outer cap 20 has a circular top panel 21 and a side wall 22, integrally formed therewith and depending from the periphery thereof. Side wall 22 has a cylindrical interior surface 23 and an exterior surface. The exterior surface is provided with spaced ribs or separations 24 for non-slip manual gripping.

The diameter of exterior surface 13 of the inner cap is slightly smaller than that of interior surface 23 of the outer cap.

Figure 2:
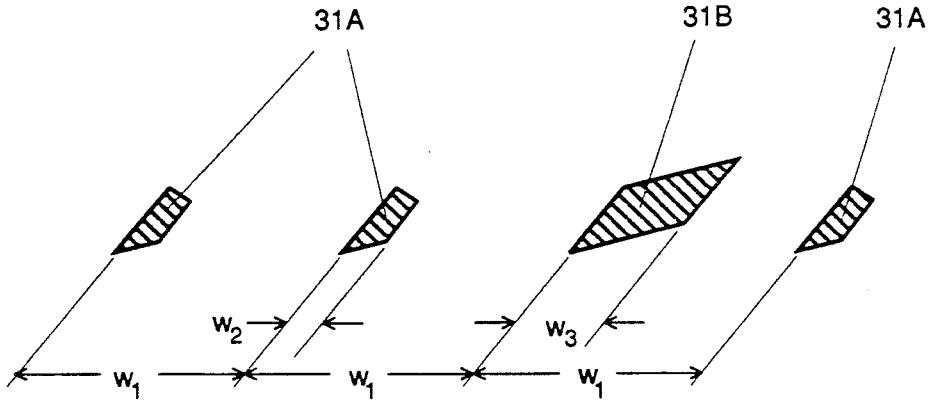
FIG. 2 shows the forms and dimensions of the protrusions.

Around the bottom of interior surface 23 of the outer cap, there is a plurality of identical type A protrusions 31A, and one type B protrusion 31B. Collectively, they will be referred to as the protrusions 31. These protrusions can be of any form but preferably have straight and parallel side edges as shown in FIG. 2. These edges are inclined to the right at a slant angle between 45° to 60°. The left edges of protrusions 31 are evenly spaced around interior surface 23 of the outer cap. Let the distance between any two neighboring left edges of protrusions 31 be $w_1$.

Figure 3:
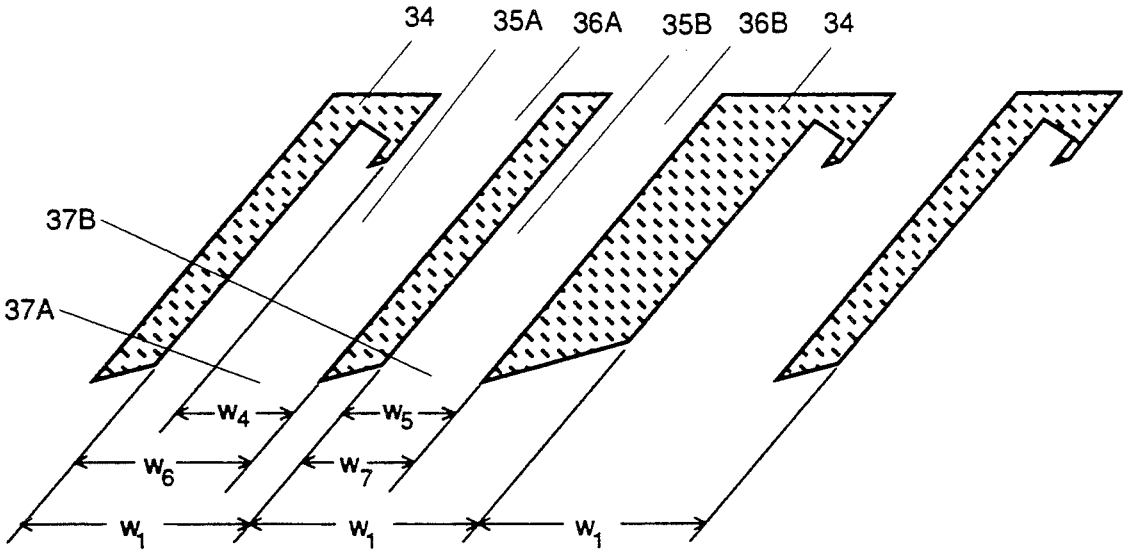
FIG. 3 shows the forms and dimensions of the grooves.

Positioned around the top of exterior surface 13 of the inner cap is a raised lip 32; positioned around the bottom of exterior surface 13 is a plurality of ridges 34, which define a plurality of intervening grooves 35 between them. The number of grooves 35 is equal to the number of protrusions 31. As shown in FIG. 3, grooves 35 have straight and parallel side edges, which are also parallel to the edges of protrusions 31. The left edges of grooves 35 are evenly spaced around exterior surface 13 of the inner cap. The distance between any two neighboring left edges of grooves 35 therefore is also equal to $w_1$; i.e. the same as the distance between any two neighboring left edges of protrusions 31.

Lip 32 and ridges 34 define an annular groove 33 between them.

The raises of protrusions 31, of lip 32, of ridges 34 and the diameters of exterior surface 13 and of interior surface 23 are so designed that inner cap 10 and outer cap 20 can be manufactured separately, then "snapped" together. The raise of lip 32 can be slightly reduced on top to facilitate this snapping. The height of annular groove 33 must be such that, once snapped together, outer cap 20 can be rotated loosely relatively to inner cap 10, with protrusions 31 freely moving inside annular groove 33. The raise of lip 32 would prevent the separation of the two caps. This relative axial position of the two caps will be referred to as their second relative axial position and is depicted in developed view in FIG. 5.

Figure 6:
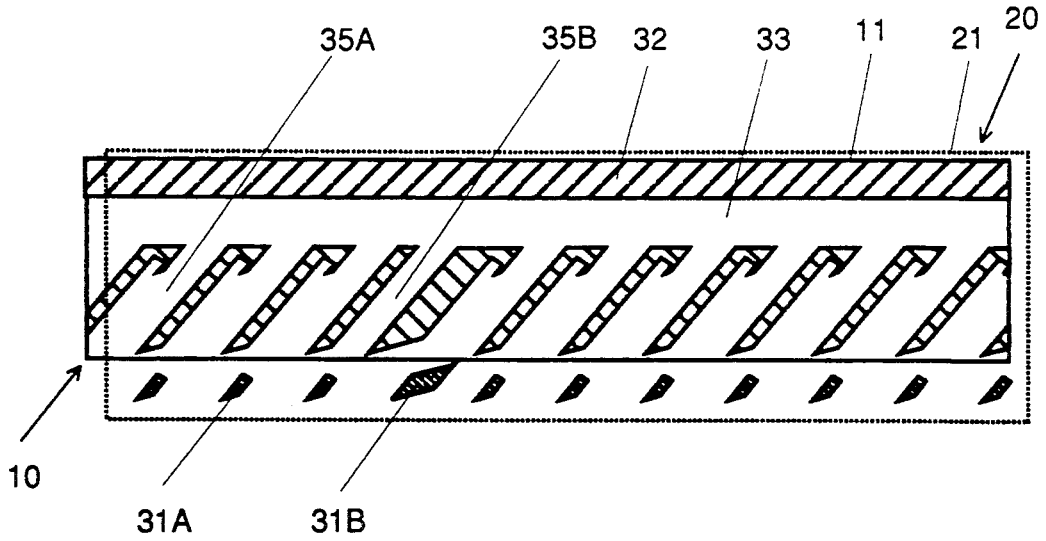
FIG. 6 is a developed view of the first relative axial position of the outer cap and the inner cap.

As disclosed in more details later, the dimensions of grooves 35 must be such that, when the two caps are in their second relative axial position, protrusions 31 can "slide down" along grooves 35, with one protrusion in one groove, bringing the two top panels 11 and 21 together. The vertical height of side wall 22 must be long enough for protrusions 31 to slide down to a position under the lower edge of inner cap 10, enabling outer cap 20 to rotate loosely relatively to inner cap 10, with protrusions 31 moving freely under ridges 34. When the two top panels 11 and 21 touch each other, the relative axial position of the two caps will be referred to as their first relative axial position and is depicted in developed view in FIG. 6.

The bottom surface of top panel 21 has a plurality of spaced ratchet teeth 42, all inclined in the same direction. The top surface of top panel 11 also has another plurality of spaced ratchet teeth 41, which are complementary to ratchet teeth 42. When it is desired to close container 1, the two caps are first snapped together, brought into their first relative axial position, then closure 5 is positioned so that inner cap 10 is in engagement with neck 2, finally outer cap 20 is rotated clockwise. This causes inter-engagement between the two sets of ratchet teeth 41 and 42, resulting in the simultaneous rotation of inner cap 10 in the same direction, screwing closure 5 onto container 1. After closure 5 is secured onto container 1, if outer cap 20 is rotated in the counter-clockwise direction, then the two sets of ratchet teeth 41 and 42 permit overriding relative to each other, playing no part in the unsecurement of closure 5 from container 1.

Referring to FIG. 3, ridges 34 are so designed that intervening grooves 35 comprise of a plurality of identical type A grooves 35A and one type B groove 35B.

Each of type A grooves 35A has a type A upper opening 36A, by which it communicates with annular groove 33. These upper openings are on the right sides of grooves 35A.

Each of type A grooves 35A also has a lower opening 37A, by which it communicates with the lower edge of side wall 11.

Type B groove 35B has a type B upper opening 36B, by which it communicates with annular groove 33. It is formed on both sides by the edges of groove 35B.

Type B groove 35B also has a lower opening 37B, by which it communicates with the lower edge of side wall 11.

Let the width of a protrusion, or a ridge, or a groove, or an opening . . . be defined as the horizontal distance between its right and left edges and let $w_2$ = the width of type A protrusions 31A;
$w_3$ = the width of type B protrusion 31B;
$w_4$ = the width of type A upper openings 36A;
$w_5$ = the width of type B upper opening 36B;
$w_6$ = the width of type A grooves 35A;
$w_7$ = the width of type B groove 35B.

Then we must have the following relationship:

$$w_2 < w_3 < (w_3 + d) = w_5 = w_7 \leqq w_4 < w_6 < w_1, \quad (I)$$

where d is a small quantity.

Figure 7:
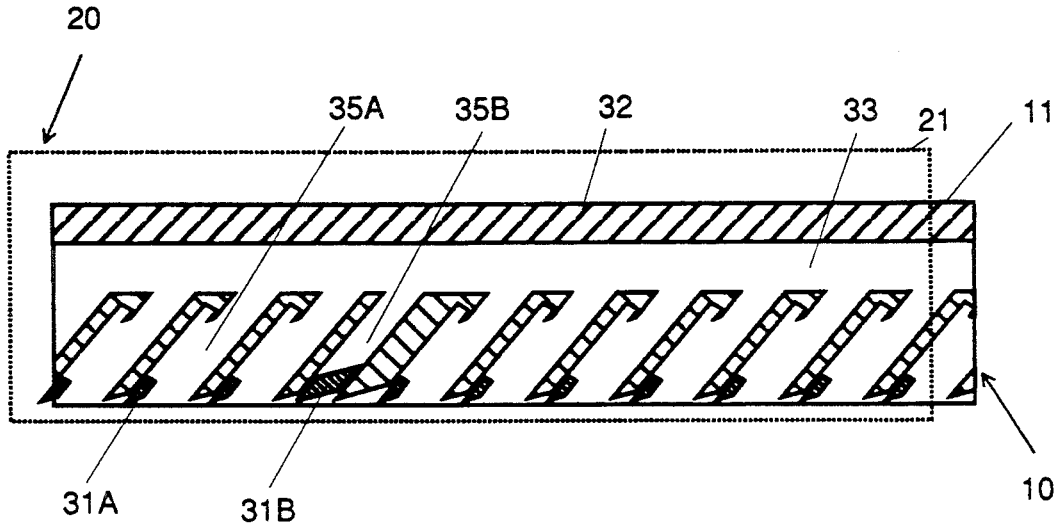
FIG. 7 is a developed view of the outer cap and the inner cap, when the type B protrusion is in the type B groove.
Figure 9:
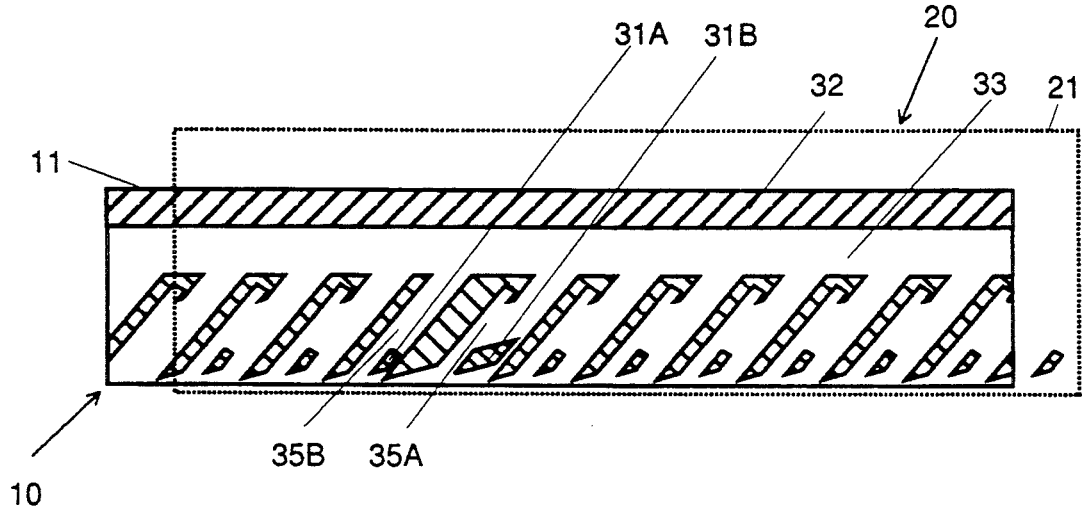
FIG. 9 is a developed view of the outer cap and the inner cap, when the type B protrusion is in one of the type A grooves.

Relationship (I) assures that, when the two caps are in their first relative axial position, if outer cap 20 is lifted away from inner cap 10, protrusions 31 can move up into grooves 35, with one protrusion in one groove, as shown in FIGS. 7 and 9. The upper edges 38 of protrusions 31 and the lower edges 39 of ridges 34 are inclined in a complementary manner to facilitate bringing the protrusions into the grooves.

Figure 4:
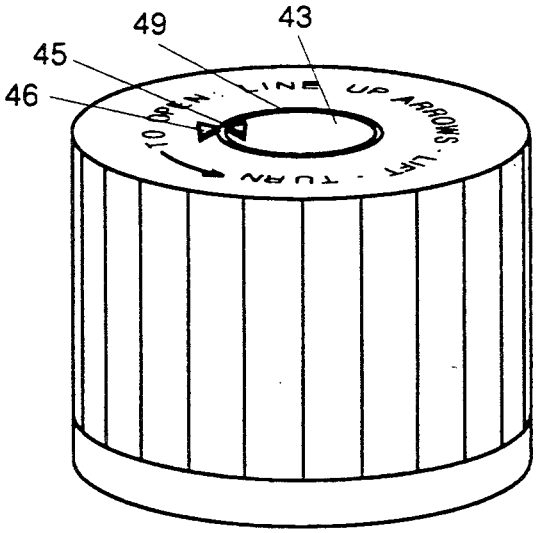
FIG. 4 represents a perspective view of the closure, showing the upper surface of the top panel of the outer cap.

Referring to FIGS. 1 and 4, the upper surface of top panel 11 is provided with an upstanding central post 43 and top panel 21 is provided with a central opening 44. The diameter of central opening 44 is slightly greater than that of central post 43 so that, when the two caps are brought together into their first relative axial position, central post 43 passes into central opening 44. The height of central post 43 is such that, when the two caps are in their first relative axial position, its top surface generally flushes with the top surface of top panel 21. The top surface of central post 43 is provided with an arrow 45, pointing away from its center; the top surface of top panel 21 is also provided with another arrow 46, pointing toward the center of central post 43. These two arrows are so positioned that, when they are aligned with each other, lifting outer cap 20 away from inner cap 10 will bring type B protrusion 31B into type B groove 35B.

Figure 8:
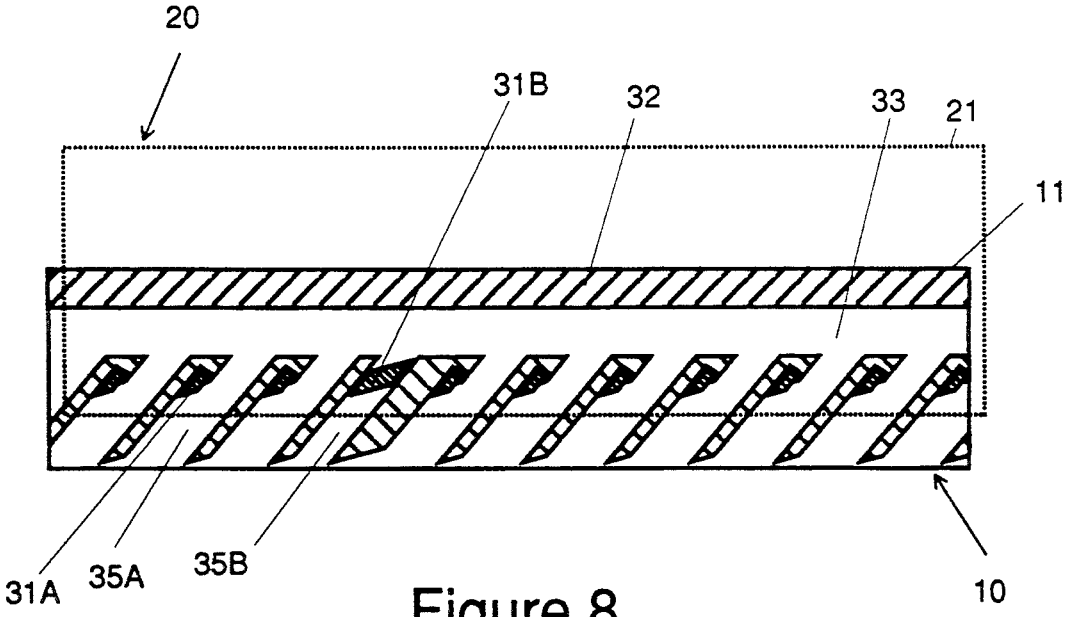
FIG. 8 is another developed view of the outer cap and the inner cap, when the type B protrusion is in the type B groove.

Suppose now that type B protrusion 31B is lifted into type B groove 35B as shown in FIG. 7. Rotating outer cap 20 in the counter-clockwise direction will force protrusions 31 to move up to the tops of grooves 35 as shown in FIG. 8. At this position, since the width $w_7$ of groove 35B is only slightly large than the width $w_3$ of protrusion 31B, all left edges of protrusions 31 are close to the left edges of grooves 35 and type A protrusions 31A are thus on the left of type A grooves 35A. Since openings 36A are on the right of grooves 35A, type A protrusions 31A cannot go through type A openings 36A: inter-locking of the two caps occurs. This relative position of the two caps will be referred to as their inter-locking position. Further rotation of outer cap 20 in the counter-clockwise direction, using the same force as that required to unscrew an equivalent non-safety cap, would result in the simultaneous rotation of inner cap 10 in the same direction, thus unsecuring closure 5 from container 1.

Normally, when someone tries to unsecure closure 5 from container 1, the two caps are in their first relative axial position. To be able to unsecure closure 5 from container 1 successfully, a person must sequentially:

(i) rotate outer cap 20 so that the two arrows 45 and 46 are aligned with each other:

(ii) lift outer cap 20 away from container 1, bringing type B protrusion 31B into type B groove 35B, as in FIG. 7;

(iii) rotate outer cap 20 counter-clockwise, until inter-locking of the two caps occurs, as in FIG. 8;

(iv) continue to rotate outer cap 20 counter-clockwise, causing inner cap 10 to move in the same direction, resulting in an unsecurement of closure 5 from container 1.

Figure 11:
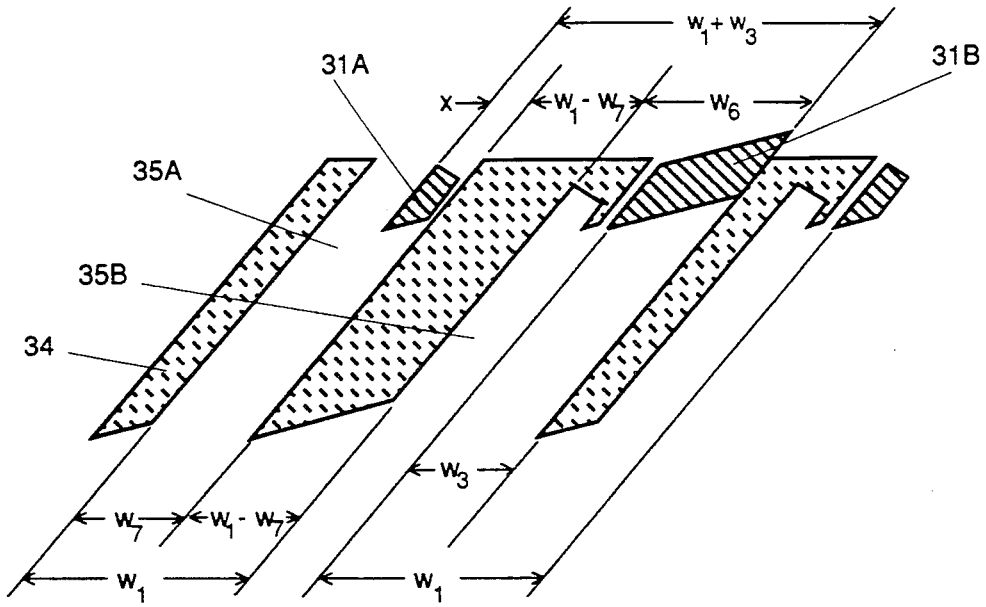
FIG. 11 shows how the maximum width of the type A grooves can be calculated.

Suppose now that a person does not perform step (i) and lifts type B protrusion 31B into one of type A grooves 35A as shown in FIG. 9. Rotating outer cap 20 in the counter-clockwise direction will move protrusions 31 to the right of grooves 35. It is important that type A protrusions 31A are not so thick that one of their right edges touches the right edge of type B groove 35B first, preventing the right edge of type B protrusion 31B from touching one of the right edges of type A grooves 35A. With the help of FIG. 11, it can be seen that this condition can be satisfied if:

$$w_2 \leqq x = (w_1 + w_3) - (w_1 - w_7) - w_6 = w_3 + w_7 - w_6. \quad \text{(ii)}$$

Figure 5:
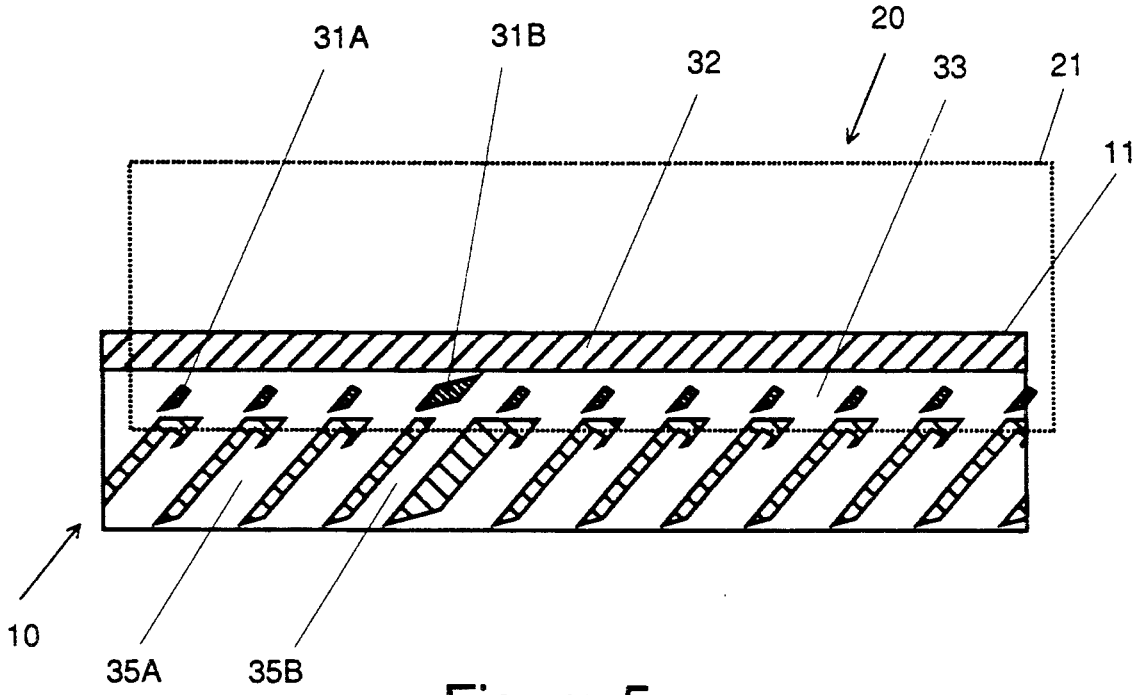
FIG. 5 is a developed view of the second relative axial position of the outer cap and the inner cap.
Figure 10:
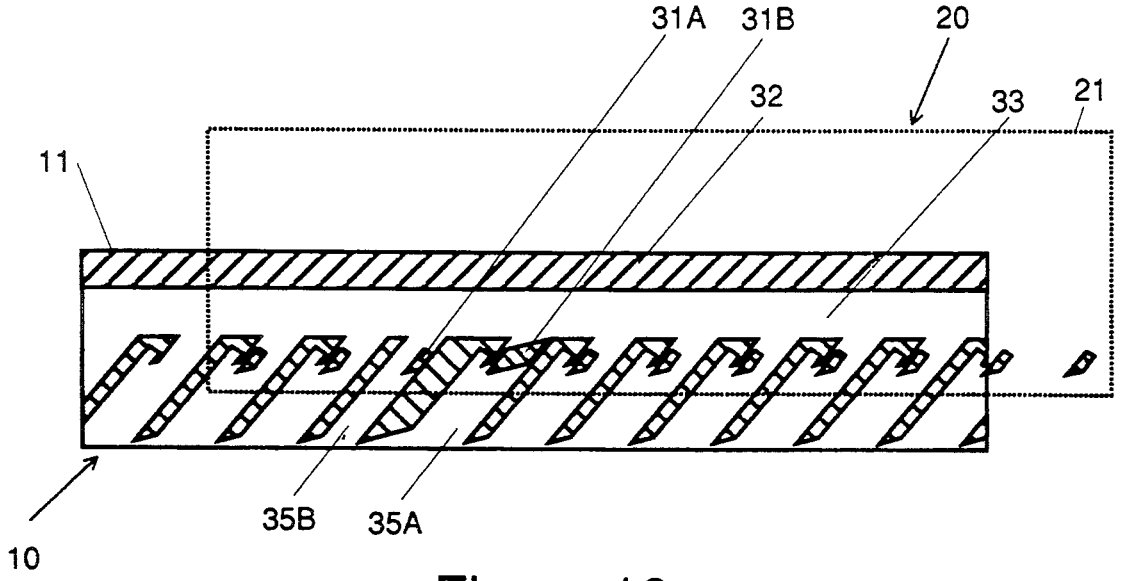
FIG. 10 is another developed view of the outer cap and the inner cap, when the type B protrusion is in one of the type A grooves.

Assuming henceforth that relationship (II) holds, then continuing rotating outer cap 20 in the counter-clockwise direction will force protrusions 31 to move to the top of grooves 35, with type B protrusion 31B staying on the right side of one of type A grooves 35A as shown in FIG. 10. Since openings 36A are also on the right side of grooves 35A and since the width $w_4$ of opening 36A is larger than the width $w_3$ of protrusion 31B, protrusions 31 can pass through openings 36A and 36B, bringing the two caps into their second relative axial position as shown in FIG. 5. Outer cap 20 is now rotated without unsecuring closure 5 from container 1.

Suppose that a child tries to unsecure closure 5 from container 1. Not knowing the above steps (i) and (ii), he or she can only rotate outer cap 20 around and around, because the caps will remain in their first relative axial position. Even if the child lifts outer cap 20 away from container 1 as in step (ii), the probability that type B protrusion 31B will enter into type B groove 35B is small. Normally, this would result in protrusions 31 passing through openings 36A and 36B, bringing the two caps into their second relative axial position without unscrewing the closure.

Actually, when type B protrusion 31B is in the middle of one of type A grooves 35A as shown in FIG. 10, closure 5 can still be unscrewed from container 1 by exerting a downward axial force to keep the two caps in this intermediate axial position, while rotating the outer cap counter-clockwise, forcing inner cap 10 to rotate simultaneously with outer cap 20. While an impatient adult might use this method, a small child would not have sufficient strength for it.

When inner cap and outer cap 20 are in their second relative axial position, relationships (I) and (II) also assure that protrusions 31 can move though openings 36A and 36B to slide down along grooves 35 to bring the two caps into their first relative axial position.

This invention thus satisfies the object of providing a new and improved safety closure for containers having threaded necks which can only be unscrewed by persons having given instruction and skill. Once a person follows the prescribed steps, he or she does not need to exert force stronger than that which would be required to unscrew an equivalent non-safety cap.

This invention also satisfies the object of providing a new and improved safety closure which is not too complicated to unscrew from a container having threaded neck, yet sufficiently complicated to prevent a child from doing so. It requires the user to align two arrows, then give it an upward lift while turning in the counter-clockwise direction.

A few comments are in order here:

1. There is quite a wide range of designs of protrusions 31 and grooves 35 that can satisfy both relationships (I) and (II) simultaneously. One such design is as follows:

$w_2 = (\frac{1}{4})w_1 - d_1$,
$w_3 = (\frac{1}{2})w_1 - d$,
$w_4 = w_5 = w_7 = (\frac{1}{2})w_1$,
$w_6 = (\frac{1}{4})w_1$, where d is a small number and $d \leqq d_1 < (\frac{1}{4})w_1$.

If $d_1 = d$, then the total width of protrusions 31A is nearly one fourth of the circumference of exterior surface 13. This creates a very stable inter-locking of the two caps when they are in their inter-locking position.

It is preferable, however, that type A protrusions 31A be made a little bit narrower. This allows ridges 34 to form "hooks" around them, as shown in FIG. 8.

Figure 12:
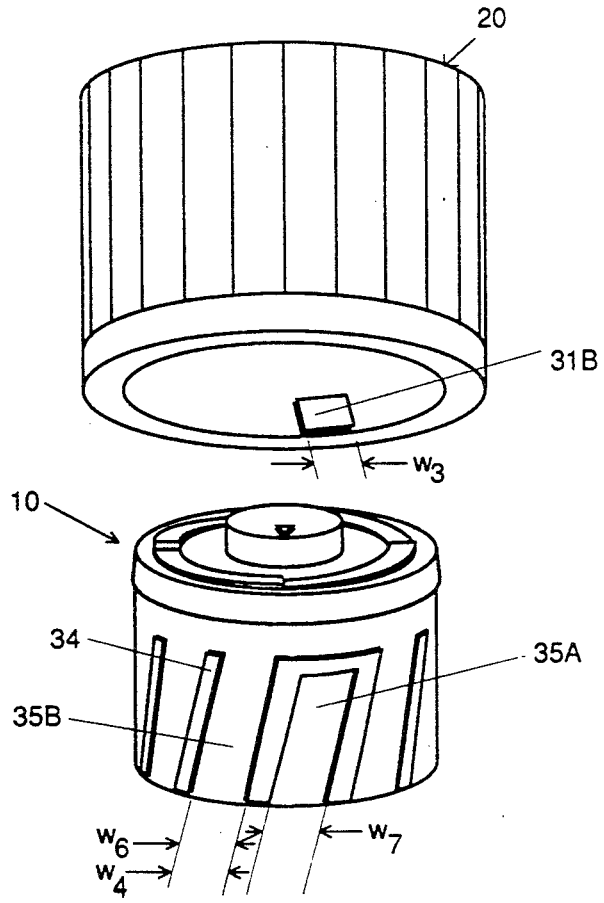
FIG. 12 represents a perspective view of the outer cap and the inner cap, when the type A protrusions do not exist.

2. It is possible, although not recommended, that width $w_2$ of type A protrusions 31A degenerate to zero, as shown in FIG. 12. In this case:

$w_3 = w_4 - d$;

$w_4 = w_6 = w_7$;

$w_5 = 0$

In other words, in this design, type A protrusions 31A do not exist, all grooves 35 have the same widths and the only difference between type A grooves 35A and type B groove 35B is that type B groove has no opening toward annular groove 33.

While this design reduces the inter-locking capacity of the two caps, it does not seem to have any advantage over the basic design having distinct type A protrusions.

3. The two arrows 45 and 46 do not have to be perfectly aligned for type B protrusion 31B to move into type B groove 35B. There is a region around arrow 45 which will allow this to happen as long as arrow 46 is moved into it. The width of this region is a function of the number of grooves 35: the higher this number, the narrower the region and thus the "safer" the closure. This number can not be too high, however, as this would result in thin, hence weak, protrusions 31, ridges 34 and grooves 35. Ten seems to be a right number.

4. The probability that a child, without performing the above step (i), lifts type B protrusion into type B groove will be smaller if the two sets of teeth 41 and 42 are so positioned that arrows 45 and 46 are not generally aligned when closure 5 is screwed onto container 1.

5. Since closure 5 does not have any flexible members such as the leaf springs, identified by numerals 18, 19, 20 and 21 in Mumford et. al., U.S. Pat. No. 3,857,505, this invention is easier to be designed and manufactured than the familiar push-down-and-turn type. If a company has been producing the latter type, it is very easy to adapt its machinery to the present invention. This invention thus satisfies the object of providing a new and improved safety closure which is not too complicated for design and manufacture, at least not more complicated than any existing closure having an inner cap and an outer cap.

6. As shown in FIG. 4, closure 5 may also be provided with a tamper-resistant means. This may be in a form of a thin, frangible seal 49, filling the gap between central post 43 and outer cap 20. This seal keeps the two caps in their first relative axial position such that the two sets of teeth 41 and 42 are engaged. While screwing closure 5 into container 1 would not break the seal, any attempt to rotate outer cap 20 in the counter-clockwise direction or to lift it from inner cap 10 would.

An advantage of this type of seal is that it can be applied before the closure is screwed onto the container. Using this pre-sealed closure, a small pharmacy therefore does not need any equipment to seal it after filling the container with medicine.

This invention thus satisfies the object of providing new and improved safety closures which can be tamper-resistant; i.e. it unscrew the closure from the container.

7. Inner cap 10 is normally made up of resilient material while outer cap 20 of more rigid material. When inner cap 10 is in engagement with container 1, its shape is harder to deform and consequently, lip 32 is sufficient to make it hard to separate outer cap 20 from inner cap 10. On the other hand, when inner cap 10 is not in engagement with container 1, its shape can be easily deformed so that outer cap 20 can be separated from inner cap 10. Thus if desired, closure 5 can be converted into a non-safety one by discarding outer cap 20. It is important to note that a child cannot perform this conversion, as it requires closure 5 be unsecured from container 1 first.

This invention thus satisfies the object of providing a new and improved safety closure which can be easily converted into a non-safety closure.

Figure 13:
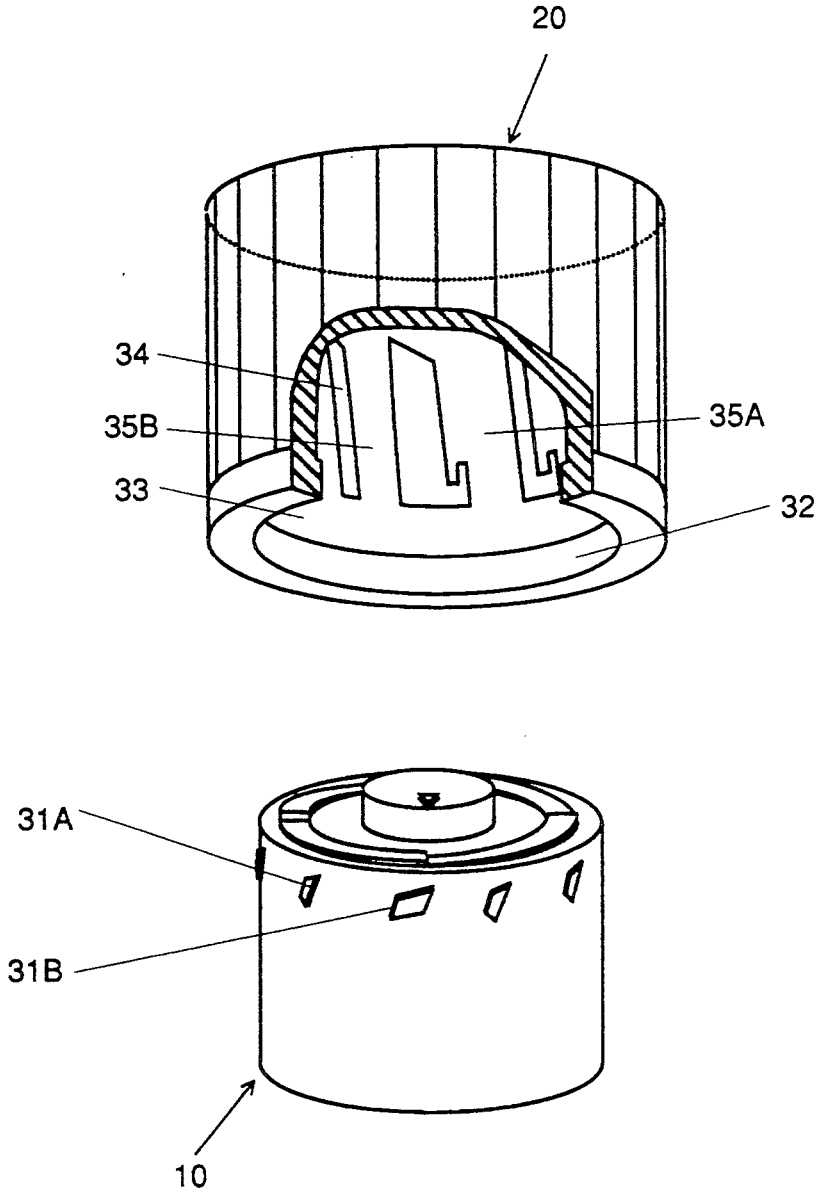
FIG. 13 represents a perspective view of the outer cap and the inner cap, when the protrusions are formed in the inner cap.

8. A preferred embodiment of this invention is shown in FIG. 13 where protrusions 31 are formed on the top of exterior surface 13 of the inner cap, grooves 35 in the middle of the interior surface 23 of the outer cap and lip 33 on the bottom of the interior surface 23 of the outer cap. There might be some merits in this arrangement as the height of inner cap 10 can now be very short. Furthermore, ridges 34 and grooves 35 are not visible when the two caps are in their second axial relative position.

While the principles of the invention have now been made clear in the illustrated embodiments, there will be obvious to those skilled in the art many modifications of structure, arrangements, proportions, elements, materials, and components used in the practice of the invention, without departing from those principles. The appended claims are therefore intended to cover and embrace such modifications within the limits only of the true spirit and scope of the invention.

I claim as my invention:

1. A safety closure for a container comprising:

(i) a cap having an inner side wall and being provided with means for permitting engagement with a container by rotation in a closing direction and removal by rotation in a reverse direction which is opposite to said closing direction, (ii) an outer side wall captive on said gap and surrounding said inner side wall, (iii) means permitting rotation of said cap by said outer side wall in said closing direction and permitting rotation of said outer side wall relative to said cap in said reverse direction, and (iv) means on said inner side wall and said outer side wall including a type A groove, a type B groove, a type A protrusion, said type A protrusion being movable within said type A groove and said type B groove, a type B protrusion, said type B protrusion being movable within said type A groove and said type B groove, when said type B protrusion is in said type B groove said type A protrusion is in said type A groove, a non-interlocking means permitting rotation of said outer side wall relative to said gap in said reverse direction when said type B protrusion is in said type A groove, and interlocking means permitting rotation of said cap by said outer side wall in said reverse direction when said type B protrusion in said type B groove.

2. The closure of claim 1 further including an annular groove, said type A groove communicating with said annular groove, said type B groove communicating with said annular groove, said type B protrusion and said type A protrusion being movable within said annular groove, when said type B protrusion is in said annular groove said outer wall is allowed to rotate relative to said gap in said reverse direction.

3. The closure of claim 2 wherein said non-interlocking means includes:

(i) a type A opening communicating said type A groove with said annular groove, the width of said type A opening being larger than the maximum width of said type B protrusion, (ii) means for guiding said type B protrusion through said type A opening when said type B protrusion is in said type A groove and said outer side wall is rotated in said reverse direction.

4. The closure of claim 3 wherein said interlocking means includes means for guiding said type A protrusion away from said type A opening when said type A protrusion is in said type A groove and said outer side wall is rotated in said reverse direction thus preventing said type A protrusion and said type B protrusion from entering into said annular groove.

5. The closure of claim 1 further including tamper-evidence means for indicating whether said inner cap has been removed from a container.

6. A safety closure for a container comprising:

(i) a cap having an inner side wall and being provided with means for permitting engagement with a container by rotation in a closing direction and removal by rotation in a reverse direction which is opposite to said closing direction, (ii) an outer side wall captive on said cap and surrounding said inner side wall, (iii) means permitting rotation of said cap by said outer side wall in said closing direction and permitting rotation of said outer side wall relative to said cap in said reverse direction, and (iv) means on said inner side wall and said outer side wall including a type B protrusion, a type A groove, said type B protrusion being movable within said type A groove, a type B groove, said type B protrusion being movable within said type B groove, the minimum width of said type B groove being larger than the maximum width of said type B protrusion, non-interlocking means permitting rotation of said outer side wall relative to said cap in said reverse direction when said type B protrusion is in said type A groove, and interlocking means permitting rotation of said cap by said outer side wall in said reverse direction when said type B protrusion is in said type B groove.

7. The closure of claim 6 further including an annular groove, said type A groove communicating with said annular groove, said type B groove communicating with said annular groove, said type B protrusion being movable within said annular groove, when said type B protrusion is in said annular groove said outer wall is allowed to rotate relative to said cap in said reverse direction.

8. The closure of claim 7 wherein said non-interlocking means includes (i) a type A opening communicating said type A groove with said annular groove, the width of said type A opening being larger than the maximum weight of said type B protrusion, (ii) means for guiding said type B protrusion trough said type A opening when said type B protrusion is in said type A groove and said outer side wall is rotated in said reverse direction.

9. The closure of claim 8 wherein said interlocking means includes a type A protrusion, said type A protrusion being movable within said type A groove and said type B groove, when said type B protrusion is in said type B groove said type A protrusion is in said type A groove, means for guiding said type A protrusion away from said type A opening when said type A protrusion is in said type A groove and said outer side wall is rotated in said reverse direction thus preventing said type A protrusion ad said type B protrusion from entering into said annular groove.

10. The closure of claim 9 further including tamper-evidence means for indicating whether said inner cap has been removed from a container.

* * * * *

UNITED STATES PATENT AND TRADEMARK OFFICE

CERTIFICATE OF CORRECTION

PATENT NO. : 5,148,931

DATED : September 22, 1992

INVENTOR(S) : Do Le Minh

It is certified that error appears in the above-indentified patent and that said Letters Patent is hereby corrected as shown below:

Col. 6, line 60, change "1/4" to --3/4--.

Col. 7, line 60, change "it unscrew" to --it provides a means of determining whether anyone has attempted to unscrew--.

Col. 8, line 34, change "gap" to --cap--.

Col. 8, line 52, change "a non-interlocking" to --non-interlocking--.

Col. 8, line 53, change "gap" to --cap--.

Col. 8, line 58, after protrusion insert --is--.

Col. 8, line 67, change "gap" to --cap--.

Col. 10, line 20, change "weight" to --width--.

Col. 10, line 21, change "trough" to --through--.

Signed and Sealed this

Twenty-third Day of November, 1993

*Attest:*

Bruce Lehman

BRUCE LEHMAN

*Attesting Officer*

*Commissioner of Patents and Trademarks*